US006899069B2

(12) United States Patent
Mattes et al.

(10) Patent No.: US 6,899,069 B2
(45) Date of Patent: May 31, 2005

(54) VALVE FOR CONTROLLING LIQUIDS

(75) Inventors: Patrick Mattes, Stuttgart (DE); Hans Brekle, Erdmannhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/450,822

(22) PCT Filed: Aug. 16, 2002

(86) PCT No.: PCT/DE02/03005

§ 371 (c)(1),
(2), (4) Date: Jan. 26, 2004

(87) PCT Pub. No.: WO03/038269

PCT Pub. Date: May 8, 2003

(65) Prior Publication Data

US 2004/0154562 A1 Aug. 12, 2004

(30) Foreign Application Priority Data

Oct. 19, 2001 (DE) ..... 101 51 688

(51) Int. Cl.[7] ..... F01L 9/02
(52) U.S. Cl. ..... 123/90.12; 251/129.06
(58) Field of Search ..... 123/90.12; 251/129.06

(56) References Cited

U.S. PATENT DOCUMENTS 4,584,980 A 4/1986 Schwerdt et al.
5,857,662 A 1/1999 Kappel et al.
6,457,699 B1 * 10/2002 Stoecklein ..... 251/129.06

FOREIGN PATENT DOCUMENTS

DE 199 46 827 6/2001

* cited by examiner

*Primary Examiner*—Thomas Denion
*Assistant Examiner*—Zelalem Eshete
(74) *Attorney, Agent, or Firm*—Ronald E. Greigg

(57) ABSTRACT

A valve for controlling fluids, in particular in an injection valve of an internal combustion engine, including a valve housing (20), in which housing a system region (21) is embodied, in which region a piezoelectric actuator module (22) and a hydraulic coupler module (23) are disposed, which has both an adjusting piston (24), on which the actuator module (22) acts, and an actuating piston (30) that is operatively connected via a hydraulic chamber (29) to the adjusting piston (24) and that is connected to a valve closing member (31) cooperating with a valve seat (37), and the adjusting piston (24) and the actuating piston (30) define the hydraulic chamber (29), and a system pressure for refilling the hydraulic chamber (29) prevails in the system region (21), from which a diversion conduit (38) branches off. The system region (21) is acted upon by a fluid via the diversion conduit (38).

19 Claims, 2 Drawing Sheets

VALVE FOR CONTROLLING LIQUIDS

CROSS-REFERENCE TO RELATED APPLICATIONS

This application is a 35 USC 371 application of PCT/DE 02/03005 filed on Aug. 16, 2002.

BACKGROUND OF THE INVENTION

1. Field of the Invention

The invention is directed to an improved valve for controlling fluids, and more particularly to a fuel injection valve for an internal combustion engine.

2. Description of the Prior Art

One valve of the type with which this invention is concerned is known in the industry and serves in particular as a control module for a fuel injection valve, in particular a common rail injector, of a motor vehicle. This known valve of has a piezoelectric actuator for actuation. A deflection of the piezoelectric actuator is transmitted to a valve closing member upon actuation of the valve, via a hydraulic chamber that acts as a hydraulic booster or coupling and tolerance compensation element. The hydraulic chamber acting as a hydraulic coupler is disposed between an adjusting piston that is connected to the piezoelectric actuator and an actuating piston that is connected to the valve closing member. The diameter of the adjusting piston is greater than that of the actuating piston, so that the actuating piston executes a stroke that is lengthened by the boosting ratio of the piston diameters, when the adjusting piston undergoes a certain deflection by means of the piezoelectric actuator.

The hydraulic chamber is designed such that leaks that occur during operation can be compensated for by refilling. To this end, a fluid pressure, or so-called system pressure, acts on the hydraulic chamber in a system region or system chamber of the valve, for instance via leakage gaps embodied at the circumference of the pistons.

The system region is acted upon by the fluid pressure in such a way that upon an actuation of the valve, the valve closing member is moved into an opening position, and fluid can flow into the system region. The fluid quantity flowing into the system region is the so-called diversion quantity, which is then removed from the system region via a so-called diversion conduit.

In one known valve, the system pressure prevailing in the system region, which is approximately 30 bar, is dammed up by means of a check valve disposed in the diversion conduit, so that the pressure prevailing in the system region is high enough to assure refilling of the hydraulic chamber.

When this valve is used in a fuel injection valve of a motor vehicle, such as a common rail injector, in which a pressure of about 1.5 kbar prevails upstream of the valve closing member, the diversion quantity flows at a high pressure into the system region, so that in the system region pressure spikes occur that may possibly impair the functioning of the actuator module, which is likewise exposed to the system pressure. Moreover, initial filling of the hydraulic coupler at the factory is necessary.

SUMMARY OF THE INVENTION

The valve for controlling fluids of the invention in which the system chamber is acted upon by a fluid pressure via the diversion conduit, has the advantage that initial filling of the hydraulic coupler at the factory is unnecessary, since the filling takes place when the valve is put into operation by means of the delivery of fluid to the system region via the diversion conduit, which may be embodied as an opening in the valve housing, so that an adequately high refilling pressure is always furnished in the system chamber or system region.

When the valve of the invention is used in a fuel injection valve of a motor vehicle, the diversion conduit may communicate with a pressure device, which at the same time can be a fuel pump of the motor vehicle. In the case of a common rail injector, the fuel pump used can be a fuel prefeed pump, disposed in a fuel tank, for pumping fuel to a high-pressure pump that furnishes the so-called common rail pressure. The prefeed pump acts on the system region via the diversion conduit, for instance at a pressure of about 5 bar.

Pressures that dam up in the system region as a result of diversion events can be diverted, in the valve of the invention, in such a way that the fluid quantity that occurs is carried directly to the high-pressure pump, instead of the diversion quantity being returned to the fuel tank. The fuel pump is expediently equipped with a pressure limiting valve, so that the pump is protected against high pressures.

In an advantageous embodiment of the valve of the invention, a throttle is provided at the diversion conduit. The effect of the throttle is that a pressure being dammed up in the system region is slowly carried away to a downstream fluid circuit. Pressure spikes that may occur in the system region, which can amount to up to 60 bar, can be diminished via the throttle. A pressure elevation in the system region is dynamically entrained by means of the throttle, which in turn means tolerable loads on the piezoelectric actuator module and thus leads to a robust valve.

The throttle is preferably formed by a tubular insert part. A tubular insert part is a simple, robust component, which is invulnerable to tolerances, in which no adjustment operations are required, which requires little installation space, and which is easy to produce. By simply replacing the tubular insert part of a certain inside diameter with a tubular insert part of a different inside diameter, the valve of the invention can be adapted without further provisions to changing operating conditions.

BRIEF DESCRIPTION OF THE DRAWING

Other features and advantages of the valve of the invention will become apparent from the detailed description contained herein below, taken in conjunction with the drawings, in which.

DESCRIPTION OF THE PREFERRED EMBODIMENT

Figure 1:
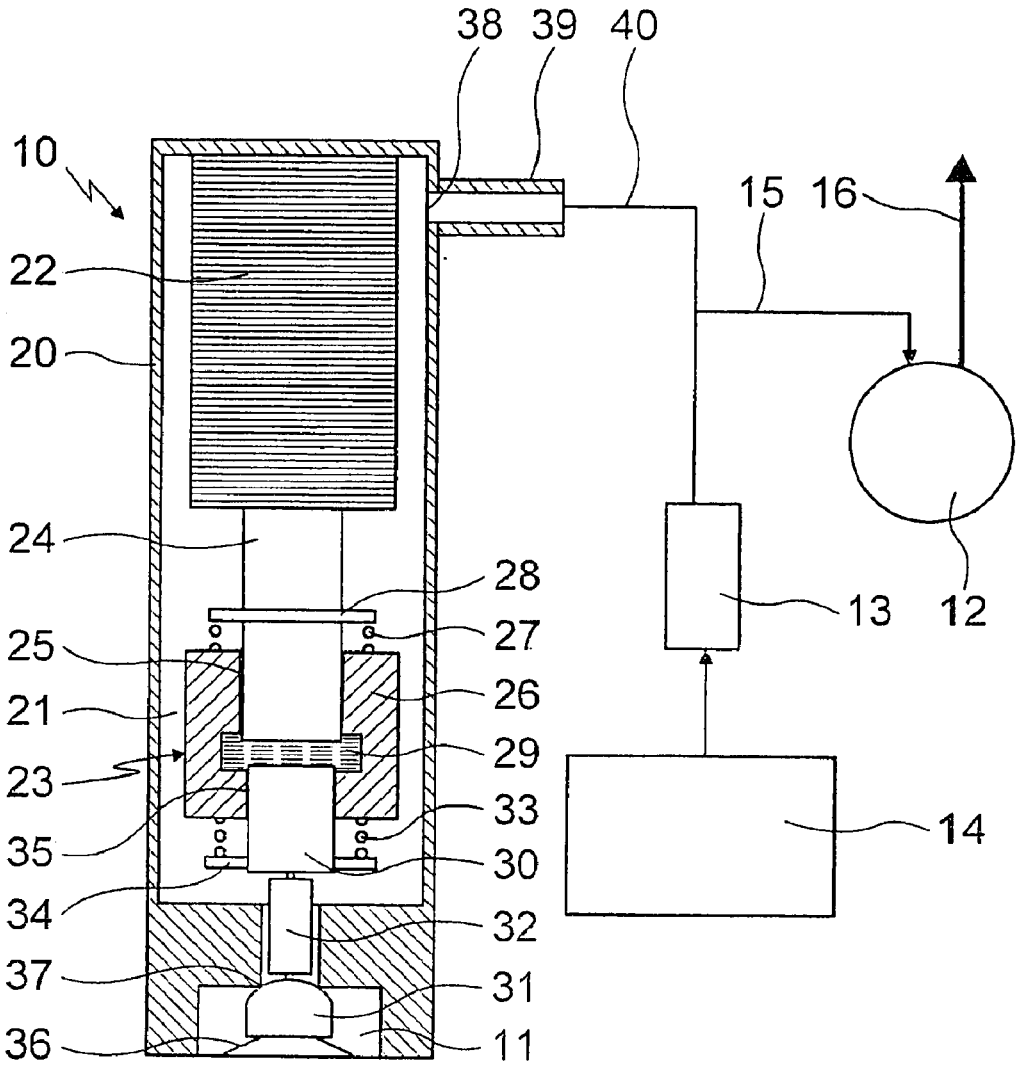
FIG. 1 shows a simplified longitudinal section through a valve of the invention in a common rail injection system of a Diesel motor vehicle.

In FIG. 1, part of a system for injecting fuel in a Diesel internal combustion engine of a motor vehicle is shown; the system includes a valve 10 for controlling fluids in a fuel injection valve. The valve 10 forms a control module for a nozzle module, not identified by reference numeral here, of the fuel injection valve or injector.

The nozzle module axially adjoins the control module and includes a nozzle needle, which is disposed and guided in a nozzle body and which controls openings in the nozzle body that lead to a combustion chamber of the engine.

The nozzle needle together with a valve control piston form a structural unit, and the valve control piston adjoins a so-called valve control chamber. The valve control chamber is in operative communication with a high-pressure fuel conduit via an inlet throttle and with a valve chamber 11 of the valve 10 via an outlet throttle. The high-pressure fuel conduit is acted upon, by means of a high-pressure pump 12, to supply fuel that is at a pressure of approximately 1.5 kbar and that is pumped by means of a prefeed pump 13 from a fuel tank 14 via a supply line 15 to the intake side of the high-pressure pump 12.

The high-pressure pump 12 has a compression side, which leads to a so-called common rail, not identified here by reference numeral, by way of which a plurality of fuel injectors are supplied with fuel, and which communicates with the aforementioned high-pressure fuel conduit, among other elements. The fuel injectors are each equipped with a control module on the order of the valve 10.

An injection event performed by the fuel injection valve described here is controlled by way of the pressure prevailing in the valve control chamber, and this pressure can be set by means of the valve or control module 10.

The valve or control module 10 includes a valve housing 20, in which a so-called system region or system chamber 21 is embodied. An actuator module 22 on the one hand and a coupler module 23 on the other are disposed in the system chamber 21.

The actuator module 22, which includes a piezoelectric actuator and is braced on the valve housing 20, is connected to an adjusting piston 24, which is associated with the coupler module 23 and is guided axially movably in a cylindrical bore 25 of a coupler housing 26.

The adjusting piston 24 is also prestressed in the direction of the actuator module 22 by means of a helical spring 27, which engages a support plate 28 connected to the adjusting piston 24 and which is braced on the coupler housing 26.

Via a hydraulic coupler 29 embodied as a hydraulic chamber, the adjusting piston 24 is operatively connected to a so-called actuating piston 30, which serves to actuate a valve closing member 31 and is connected to the valve closing member via a guide piston 32. The actuating piston 30, which is guided in a cylindrical bore 35 of the coupler housing 26, is prestressed in the direction of the valve closing member 31 by means of a helical spring 33, which is braced on the coupler body 26 and engages a further support plate 34. The diameter of the actuating piston 30 is less than that of the adjusting piston 24, and thus the hydraulic coupler 29 acts as a hydraulic booster.

The valve closing member 31 is disposed in the valve chamber 11 communicating with the valve control chamber of the nozzle module, and when the piezoelectric actuator 22 is not actuated, this valve closing member is kept in the closing position by a cup spring 36 and thus rests on a valve seat 37.

A diversion conduit 38 embodied as an opening also branches off from the system chamber 21; it is provided with a throttle 39 embodied as a tubular insert part, and it communicates via a line 40 with both the fuel prefeed pump 13 and the supply line 15 that leads to the high-pressure pump 12.

Figures 2A, 2B:
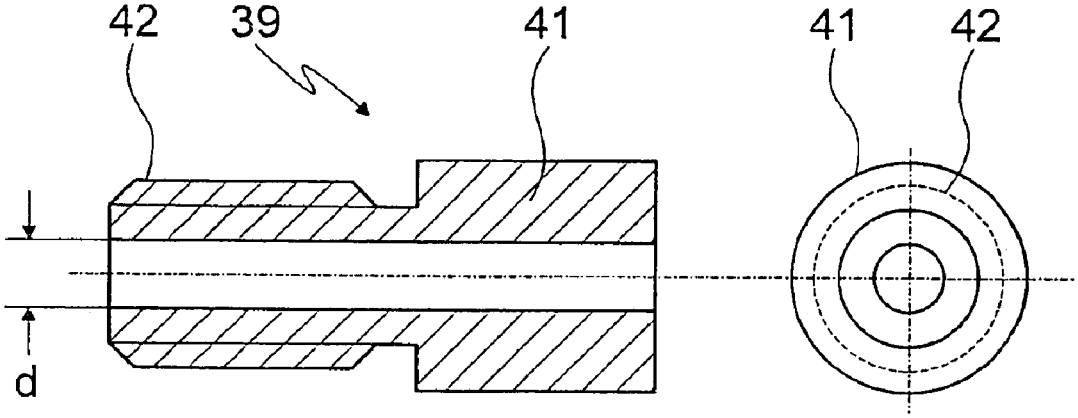
FIGS. 2*a* and 2*b* show a throttle of the valve of FIG. 1.

The throttle 39 is shown in further detail in FIGS. 2*a* and 2*b* and includes a connection region 41 for a pressure hose associated with the line 40 and also includes a screw-in thread 42 for fixation to the valve housing 20, and it has an inside diameter d of approximately 1 mm.

The valve 10 shown in FIGS. 1 and 2 functions as described below.

In operation of the injection system shown in FIG. 1, fuel is pumped out of the fuel tank 14 by the prefeed pump 13 via the supply line 15 into the high-pressure pump 12, by means of which the common rail and thus the high-pressure fuel conduit of the fuel injection valve are supplied with fuel, so that the so-called rail pressure prevails both in the valve control chamber of the nozzle module and in the valve chamber 11 of the valve 10 shown in FIG. 1.

In addition, when the system is put into operation, or in other words upon the start of the prefeed pump 13, the system chamber 21 is acted upon, via the line 40 branching off from the supply line 15 and via the throttle 39, by fuel, that is, a fluid that is at the feed pressure of the prefeed pump 13, which is in the range of 3 bar to 5 bar. The effect of this pressure is that filling of the hydraulic coupler 29 takes place via annular leakage gaps that surround the pistons 24 and 30 in the region of the bores 25 and 35. The pressure for filling the hydraulic coupler 29 is thus taken over from a pressure device that is present in the motor vehicle, in this case the fuel prefeed pump.

Upon an injection event, the actuator module 22 is subjected to a voltage, which causes it to undergo an axial lengthening and deflects the adjusting piston 24 in the direction of the valve closing member 31, thus in turn tripping a stroke of the actuating piston 30 and thus of the valve closing member 31. As a result, the valve closing member 31 is moved into the opening position, causing a diversion quantity of fuel to flow out of the valve chamber 11 into the system chamber 21. The diversion quantity is furnished to the high-pressure pump 12 via the opening 38 and the throttle 39 as well as the lines 40 and 15. The effect of the throttle 39 is that pressure spikes, which may possibly be as high as 60 bar, are dynamically diminished.

The foregoing relates to preferred exemplary embodiment of the invention, it being understood that other variants and embodiments thereof are possible within the spirit and scope of the invention, the latter being defined by the appended claims.

We claim:

1. A valve for controlling fluids, in particular in an injection valve of an internal combustion engine, comprising a valve housing (20), in which housing a system region (21) is embodied, a piezoelectric actuator module (22) and a hydraulic coupler module (23) disposed in the system region (21), the hydraulic couple having both an adjusting piston (24), on which the actuator module (22) acts, and an actuating piston (30) that is operatively connected via a hydraulic chamber (29) to the adjusting piston (24) and that is connected to a valve closing member (31) cooperating with a valve seat (37), the adjusting piston (24) and the actuating piston (30) defining the hydraulic chamber (29), means providing system pressure in the system region (21) for refilling the hydraulic chamber (29), and a diversion conduit (38) branching off from the system region (21), the system region (21) being acted upon by a fluid via the diversion conduit (38).

2. The valve of claim 1, wherein the diversion conduit (38) communicates with a pressure device (13).

3. The valve of claim 2, wherein the pressure device is a fuel pump (13) of a motor vehicle.

4. The valve of claim 1, further comprising a throttle (39) at the diversion conduit (38).

5. The valve of claim 2, further comprising a throttle (39) at the diversion conduit (38).

6. The valve of claim 3, further comprising a throttle (39) at the diversion conduit (38).

7. The valve of claim 4, wherein the throttle is formed from a tubular insert part (39).

8. The valve of claim 5, wherein the throttle is formed from a tubular insert part (39).

9. The valve of claim 6, wherein the throttle is formed from a tubular insert part (39).

10. The valve of claim 4, wherein the tubular insert part (39) has an inside diameter of between approximately 0.5 mm and 3 mm.

11. The valve of claim 5, wherein the tubular insert part (39) has an inside diameter of between approximately 0.5 mm and 3 mm.

12. The valve of claim 6, wherein the tubular insert part (39) has an inside diameter of between approximately 0.5 mm and 3 mm.

13. The valve of claim 1, wherein the diversion conduit (38) communicates with a high-pressure pump (12) for generating a rail pressure in a common rail injection system.

14. The valve of claim 2, wherein the diversion conduit (38) communicates with a high-pressure pump (12) for generating a rail pressure in a common rail injection system.

15. The valve of claim 3, wherein the diversion conduit (38) communicates with a high-pressure pump (12) for generating a rail pressure in a common rail injection system.

16. The valve of claim 4, wherein the diversion conduit (38) communicates with a high-pressure pump (12) for generating a rail pressure in a common rail injection system.

17. The valve of claim 7, wherein the diversion conduit (38) communicates with a high-pressure pump (12) for generating a rail pressure in a common rail injection system.

18. The valve of claim 10, wherein the diversion conduit (38) communicates with a high-pressure pump (12) for generating a rail pressure in a common rail injection system.

19. A valve for controlling fluids, comprising a valve housing (20), in which housing a system region (21) is embodied, a piezoelectric actuator module (22) and a hydraulic coupler module (23) disposed within the system region (21), the hydraulic couple having both an adjusting piston (24), on which the actuator module (22) acts, and an actuating piston (30) that is operatively connected via a hydraulic chamber (29) to the adjusting piston (24) and that is connected to a valve closing member (31) cooperating with a valve seat (37), the adjusting piston (24) and the actuating piston (30) defining the hydraulic chamber (29), means providing the controlled fluid at system pressure in the system region (21), including means for refilling the hydraulic chamber (29) with the controlled fluid, and a diversion conduit (38) branching off from the system region (21), the system region (21) being supplied with the controlled fluid via the diversion conduit (38).

* * * * *